US011505400B2

(12) United States Patent
Shannon

(10) Patent No.: US 11,505,400 B2
(45) Date of Patent: Nov. 22, 2022

(54) METHOD FOR PROTECTING AN OUTER JACKET OF A PHONOGRAPHIC RECORD

(71) Applicant: Thomas Shannon, Lexington, KY (US)

(72) Inventor: Thomas Shannon, Lexington, KY (US)

(73) Assignee: Thomas Shannon, Lexington, KY (US)

( * ) Notice: Subject to any disclaimer, the term of this patent is extended or adjusted under 35 U.S.C. 154(b) by 0 days.

(21) Appl. No.: 17/139,148

(22) Filed: Dec. 31, 2020

(65) Prior Publication Data

US 2022/0204254 A1 Jun. 30, 2022

(51) Int. Cl.
*B65D 85/57* (2006.01)
*B65B 25/00* (2006.01)
*B65B 53/02* (2006.01)

(52) U.S. Cl.
CPC ..... *B65D 85/548* (2013.01); *B65B 25/002* (2013.01); *B65B 53/02* (2013.01)

(58) Field of Classification Search
CPC .. B65D 85/548; B65D 85/544; B65D 85/546; B65D 71/08; B65B 25/002; B65B 53/02; B65B 27/086
USPC ..... 53/589, 442, 399, 582
See application file for complete search history.

(56) References Cited

U.S. PATENT DOCUMENTS 1,462,642 A * 7/1923 Karst ..... B65D 85/544 206/309
2,970,687 A * 2/1961 Johnson ..... B65D 85/544 206/313
3,077,263 A * 2/1963 Froehlig ..... B65D 85/548 206/313
3,232,423 A * 2/1966 Smiler ..... B65D 85/544 206/312
3,557,516 A * 1/1971 Brandt ..... B65B 61/14 53/397
3,896,604 A * 7/1975 Marantz ..... B65D 71/08 53/176
3,999,357 A * 12/1976 Marantz ..... B65B 11/585 53/442
4,005,777 A * 2/1977 Marantz ..... B65B 11/585 206/497
4,365,458 A * 12/1982 Palmer ..... B65B 25/002 53/173
4,369,088 A * 1/1983 Ohba ..... B65B 27/086 100/14
4,627,219 A * 12/1986 Omori ..... B65B 27/08 53/399
4,641,488 A * 2/1987 Garr ..... B65B 53/02 53/176
5,888,640 A * 3/1999 Marotta ..... B32B 27/32 428/308.4
6,874,635 B2 * 4/2005 Curtsinger ..... B23D 59/00 206/349
6,910,575 B2 * 6/2005 Curtsinger ..... B23D 59/00 206/303
6,988,348 B2 * 1/2006 Curtsinger ..... B23D 59/00 53/397

(Continued)

*Primary Examiner* — Andrew M Tecco
(74) *Attorney, Agent, or Firm* — Renner, Kenner, Greive, Bobak, Taylor & Weber

(57) ABSTRACT

A method for protecting an outer record jacket containing at least one record against a seam split comprises the step of applying at least one layer of stretchable film material capable of preventing a seam split around both a horizontal central axis and a vertical central axis of the outer record jacket containing at least one record.

12 Claims, 2 Drawing Sheets

(56) References Cited

U.S. PATENT DOCUMENTS

| | | | | |
|---|---|---|---|---|
| 6,994,307 | B2 * | 2/2006 | Curtsinger | B23D 59/00 206/806 |
| 7,155,880 | B2 * | 1/2007 | Curtsinger | B23D 59/00 53/397 |
| 7,487,872 | B2 * | 2/2009 | Curtsinger | B23D 59/00 206/303 |
| 8,453,421 | B2 * | 6/2013 | Tokunaga | B65B 53/02 53/442 |
| 2003/0102237 | A1 * | 6/2003 | Curtsinger | B27B 5/29 206/349 |
| 2007/0056248 | A1 * | 3/2007 | Duschek | B65B 61/202 53/399 |
| 2009/0114707 | A1 * | 5/2009 | Navarre | B65D 85/546 229/116.5 |

* cited by examiner

METHOD FOR PROTECTING AN OUTER JACKET OF A PHONOGRAPHIC RECORD

FIELD OF THE INVENTION

The present invention relates to a method of protecting the outer jacket of a phonographic record. Specifically, the present invention relates to a method of wrapping the typical packing of a phonographic record in order to prevent a seam split of the outer jacket. More specifically, the present invention relates to a method of applying a stretchable film across both central axes of a phonographic record in order to prevent the phonographic record from splitting the outer jacket at its seam.

BACKGROUND OF THE INVENTION

Long play-type phonograph record albums are long playing audio storage devices that were developed in the 1940's as an analog sound storage medium. The long playing (LP) phonograph record format is characterized by a speed of 33⅓ rpm, a 12- or 10-inch (30- or 25-cm) diameter, and mainly contains 3 to 10 songs running roughly about 20-30 minutes in length on each side. Typically made of vinyl (hence, often called "vinyl records"), LP record sales have reached 18.8 million units in 2019, with volume steadily increasing since 2006 when only 0.9 million units were produced.

Such LP phonograph records are generally distributed in a record album cover (also referred to herein as a "jacket" or "record jacket") in the form of a square envelope having one end that is open. The record jacket is dimensioned to accommodate the record within it. These album covers or jackets are generally fabricated of cardboard, paper board stock, or the like and are imprinted thereon with desired photographs, artwork and various other promotional and informative indicia.

It will be appreciated that the phonograph record album enclosed within the album jacket is slightly smaller in diameter than the record album jacket itself. Hence, during transportation of the record-containing jacket, it is well known that the record can shift within the jacket. This causes problems. First, the relative rubbing between the interior of the record album jacket and the surface of the record is not only physically damaging to the record grooves, but also serves to generate a static electric charge on the record surface acting to attract dust particles into the record jacket and onto the record surface. In order to minimize the relative rubbing between the interior of the record jacket and the record surface, most records have first been inserted into an auxiliary paper or plastic envelope or sleeve, before being inserted into the record jacket.

Like the album cover or jacket, the auxiliary paper envelope or sleeve also has one end that is open for accommodating the record and has a size that allows the record to be slid into the sleeve and the record and sleeve to be slid into the record jacket. Thus, the record has a diameter smaller than the sleeve, which has a diameter that is smaller than the jacket.

While most records were typically designed to be sold in a brick-and-mortar store without much handling of the record, a major market change has occurred wherein there has been an increased use of shipping of these records as opposed to direct consumer purchasing in a brick-and-mortar store. While there has been a minor uptick in the amount of brick-and-mortar record stores opening in the past 5 years, shipping direct to consumers remains in high demand. Unfortunately, shipping records comes a with greater risk of damaging both the record and the record's outer jacket.

It has been found that many of the outer jackets having a record therein gets damaged in transit during shipping, especially when sending by courier or by mail. Most of the damage to the record jacket is in the form of a "seam split" along one or more edges of the record jacket. A seam split occurs when the outer edge of an internal record disc slices through an edge portion or seam of the outer protective jacket. For collectors, seam split can degrade the value of the record with the record jacket by as much as 50% or more. Thus, a seam split is detrimental to the record and the record jacket.

Seam splits are caused by the rapid motion of the record disc within the jacket against the seam. With enough force, the record essentially cuts the cardboard or paper stock board that is the record jacket at an edge, leaving a jagged, typically white (as many record jackets are made from white paper stock or cardboard) crack on the outside of the record jacket Sometimes, the crack is severe enough that the record cuts completely through the cardboard record jacket.

While the auxiliary paper or plastic sleeve offers some protection against a seam split happening to the record album jacket, it will be appreciated that the auxiliary paper or plastic sleeve also has an open edge that does not afford any protection to the jacket against the motion of the record disc hitting the seam edge of the record jacket where the paper sleeve is open. Typically (but not always), the right-side edge of the record album outer jacket is the open portion of the album outer jacket for sliding the record with the sleeve into the jacket. The open edge of the paper sleeve is typically, but not always, at the top edge of the sleeve. Accordingly, the top edge seam (or the edge seam having the open edge of the sleeve) of the outer jacket remains unprotected from the record disc's movement. Thus, forceful movement of the record within the jacket causes the record disc to slice through the cardboard or paper stock seam of the outer jacket, causing the seam split. In some cases, seam splits can appear on the outer jacket even at seams where the paper sleeve is not open. Thus, the record disc can cut through the paper sleeve and then the outer jacket. And sometimes, it has been known that the record can cut all the way through the outer jacket such that even the shrink wrapping typically used to "protect" the record during shipping is cut. Therefore, there is a need in the art for a means of protecting a record jacket against seam splits.

SUMMARY OF THE INVENTION

It will be appreciated that a record is typically circular while a record jacket is typically square. Accordingly, most, if not all, seam splits occur at the middle of an edge of the record jacket. Thus, the present invention seeks to prevent seam splits by reinforcing the outside of the record jacket at the middle part of each edge of the record jacket. It has been found that by reinforcing the middle part of each edge of the record jacket on the outside of the record jacket, seam splits are prevented.

One embodiment of the present invention provides a method for protecting an outer record jacket containing at least one record against a seam split comprising at least the step of applying at least one layer of stretchable film material capable of preventing a seam split around both a horizontal axis and a vertical axis of the outer record jacket containing at least one record.

Further steps of the invention may comprise a step of placing each of the least one record in an inner protective envelope to provide at least one enveloped record, a step of placing each of the at least one enveloped record into its own outer record jacket to provide at least one jacketed record, and a further step of covering the at least one jacketed record with a layer of protective shrink wrap to provide at least one shrink-wrapped record jacket. The at least one layer of stretchable film material capable of preventing a seam split is applied directly over the protective shrink wrap.

Further aspects of the invention may be provided wherein the step of applying includes first applying at least one layer of stretchable film material around the horizontal central axis of the outer record jacket of the at least one record followed by applying the at least one layer of stretchable film material around the vertical central axis of the outer record jacket of at least one record.

Other aspects of the invention may be provided wherein the step of applying includes applying two layers of stretchable film material around the horizontal central axis of the outer record jacket of the at least one record followed by application of two layers of stretchable film material around the vertical central axis of the outer record jacket of the at least one record.

Still other aspects of the invention are directed to the layer(s) of stretchable film material, wherein each of the at least one layer of stretchable film material is between about 1.5 inches and about 6 inch in width, and wherein each of the at least one layer of stretchable film material has a thickness between about 120 gauge and 40 gauge.

Further aspects of the invention are found in the methods, above, wherein the step of applying is done by hand or with the use of automated equipment.

Yet other aspects of the invention are provided by the method, as above, but wherein there are a plurality of records. It will be appreciated that each record of the plurality of records is individually placed within separate inner protective envelopes to create a plurality of enveloped records, each enveloped record of the plurality of enveloped records is individually placed within separate outer record jackets to create a plurality of jacketed records, each jacketed record of the plurality of jacket records is individually covered with a layer of protective shrink wrap to create a plurality of shrink-wrapped record jackets, each shrink-wrapped record jackets of the plurality of shrink-wrapped record jackets are stacked on top of one another to create a stack of shrink-wrapped record jackets, and the at least one layer of stretchable film material is applied around the horizontal central axis of the stack of shrink-wrapped record jackets followed by the at least one layer of stretchable film material being applied around the vertical central axis of the stack of shrink-wrapped record jackets.

Another embodiment of the present invention provides a method for preventing a seam split from occurring at the middle portion of an edge of a record jacket containing a record comprising: wrapping at least one layer of a stretchable film material of at least two inches in width around both a horizontal central axis and a vertical central axis of the record jacket, the stretchable film material being wrapped sufficiently tight to at least partially stretch the film material and having a thickness and integrity sufficient to absorb any energy applied by a movement of the record against the record jacket so as to prevent any seam split at the edge of the record jacket.

Other aspects of this invention include providing a thickness of the stretchable film material to be between 120 gauge and 40 gauge.

BRIEF DESCRIPTION OF THE DRAWINGS

For a more complete understanding of the features and advantages of the present invention, reference is now made to the detailed description of the invention along with the accompanying figures in which.

DETAILED DESCRIPTION OF ILLUSTRATIVE EMBODIMENTS

Figure 1:
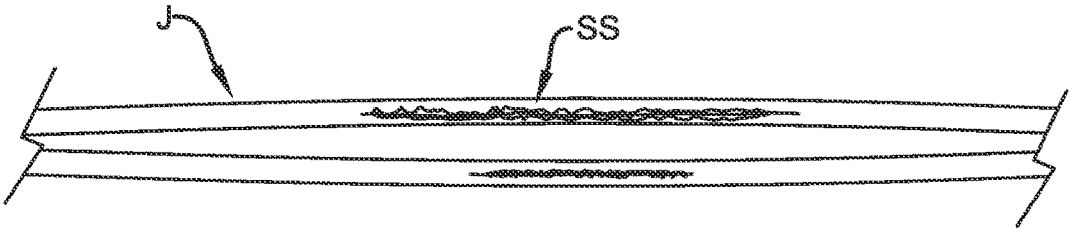
FIG. 1 shows a cardboard record jacket that has suffered a seam split.

During the shipping of disc-type records such as LP records or vinyl records, a "seam split" sometimes occurs. A seam split occurs when the record shifts or moves within the outer record jacket and based on the momentum of the shifting record, the record slices through a portion of an edge of the outer protective jacket. The condition of the outer protective jacket often controls the ultimate value of the particular record album. A record that has caused a seam split SS of the outer protective jacket J is shown in FIG. 1. While a layer of protective shrink wrap may help to diminish slightly the severity of a seam split, the shrink wrap commonly used by record producers and manufacturers that surround the entirety of the outer record jacket, by itself, is not enough to prevent seam splits at the edges of a record jacket.

Figure 2A:
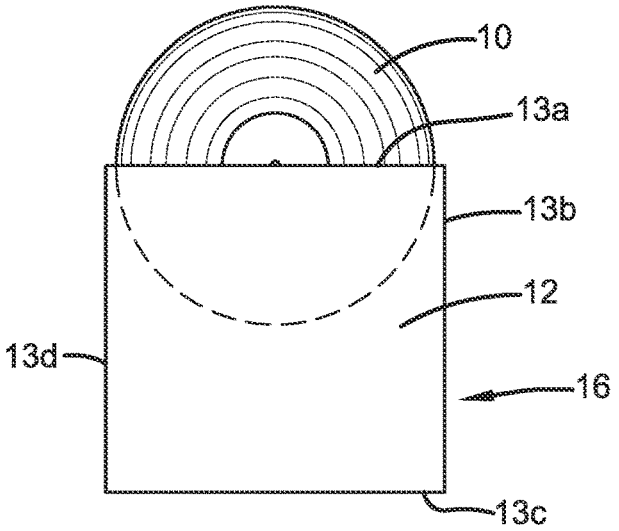
FIG. 2A shows a record being placed within an inner protective envelope or sleeve to provide an enveloped record.

Disc-type phonograph records, also known as LP records or vinyl records (hereinafter referred to as a "record"), typically include the following elements when shipped to a consumer: the record 10, an inner auxiliary paper or plastic envelope or sleeve 12; and a record jacket 14. First, the record 10 is placed within the inner auxiliary paper or plastic envelope or sleeve 12 through an open edge 13*a* thereof to create an enveloped record 16 as shown in FIG. 2A. It will be appreciated that the auxiliary envelope or sleeve 12 may comprise two sheets of substantially square paper bound together at three of its four edges 13*b*, 13*c*, 13*d*. The other edge 13*a* is not sealed, but rather left open to act as an acceptance means for sliding the record 10 into the sleeve 12.

Figure 2B:
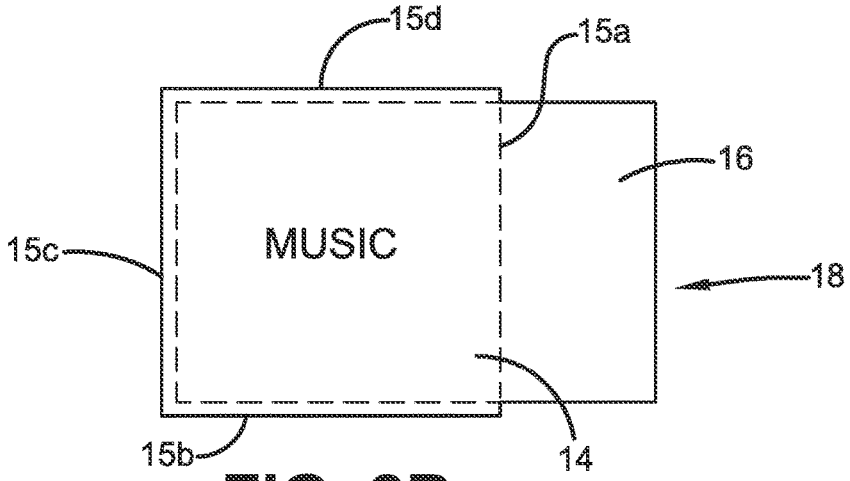
FIG. 2B shows the enveloped record of FIG. 2A being placed within a record jacket to provide a jacketed record.

Then, the enveloped record 16 is placed within the record jacket 14 through an open edge 15*a* thereof to create a jacketed record 18, as shown in FIG. 2B. It will be appreciated that the typical record jacket 14 may comprises two sheets of substantially square cardboard or paper board stock bound together at three of its four edges 15*b*, 15*c*, and 15*d*, with the other edge 15*a* not being sealed, but rather left open to provide receiving means for the record 10 and sleeve 12. While not shown specifically, it will be further appreciated that, typically, the open edge 13*a* of the sleeve 12 is not set forth in the same direction as the open edge 15*a* of the record jacket 14. This prevents the record 10 from sliding out of the sleeve 12 and also out of the record jacket 14 if the openings were both in the same direction. Thus, to prevent this, as an example, if the open edge 15*a* of the record jacket 14 were at the right-side edge, then the open edge 13*a* of the sleeve 12 would be in a direction other than to the right-side edge, i.e., either at the top edge, bottom edge or left-side edge.

In another embodiment, the record jacket may hold more than one record. With such albums, there are typically no open edges around the outside of the record jacket. Instead, there is a fold (not shown) combining to record jackets together with the opening for inserting the record or enveloped record set forth toward the fold of the record jacket. In such an embodiment, it will be appreciated that there will then be two edges on three sides of the record jacket and one folded edge on the other side of the record jacket. This means that even more seam splits could occur at each edge (up to seven total edges) of the record jacket.

Figure 2C:
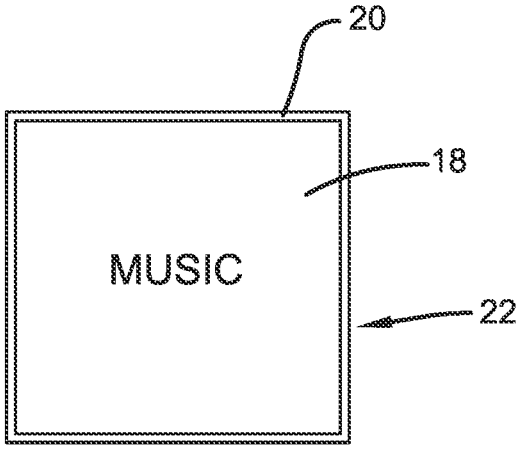
FIG. 2C shows the jacketed record of FIG. 2B being covered in shrink wrap to provide a shrink-wrapped record jacket.

Once all records 10 and sleeves 12 are in the record jacket 14, the jacketed record 18 may be covered entirely in a layer of protective shrink wrap 20 to create a shrink-wrapped record jacket 22 as shown in FIG. 2C. Shrink wrapping of record jackets is well known in the art and is not further detailed here except to note that upon shrink wrapping, the entirety of the record jacket 14 is sealed, including the open edge 15*a* of the record jacket 14, so that the record 10 and/or sleeve 12 cannot slide out of the record jacket 14.

Figure 2D:
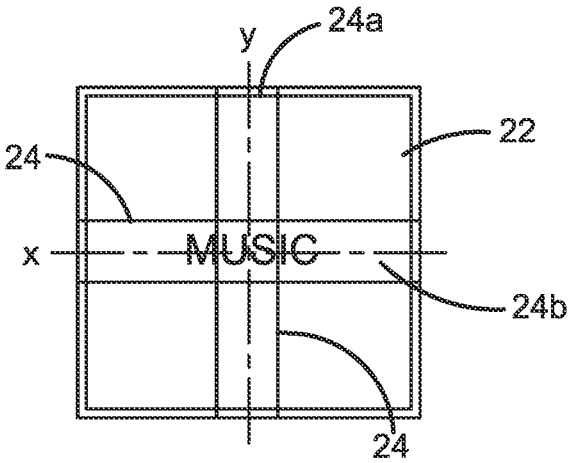
FIG. 2D shows the shrink-wrapped record jacket of FIG. 2C protected by the jacket protection means of the present invention.

FIG. 2D shows a shrink-wrapped record jacket 22 that has had the jacket protective means 24 of the present invention applied thereon. Jacket protective means 24 comprises at least one layer of a stretchable film material wrapped around both the horizontal central axis x and the vertical central axis y of the shrink-wrapped record jacket 22. FIG. 2D shows a horizontal application 24*b* of the jacket protective means and a vertical application 24*a* of the jacket protective means.

Importantly, the stretchable film material 24 should wrapped around the shrink-wrapped record jacket 22 sufficiently to securely hold the record jacket with at least some stretching of the film material. Furthermore, the film material should be wide enough to cover that portion of each edge, i.e., the middle portion corresponding to the horizontal central axis x or the vertical central axis y of each respective edge 15*a*, 15*b*, 15*c* and 15*d*, that is particularly susceptible to cracking or forming a seam split upon forcible movement of the record within the record jacket. Still further, the film material should be thick enough to absorb the energy created by the movement of the record 10 contacting the record jacket 14 in order to prevent the seam edges of the record jacket 14 from splitting. That is, the stretchable film material, having a width sufficient to cover the edges where seam splitting could take place and having a thickness sufficient to absorb the energy created by the movement of the record within the record jacket, should be wrapped around both the vertical central axis y and the horizontal central axis x at least once sufficiently to at least partially stretch the film material. In this manner, the film material will prevent seam splits from developing on the record jacket.

The stretchable film material of the present invention may be made of any material suitable for its purpose set forth above. In one embodiment, a plastic film material may be used that is suitable for use on either the shrink wrap or the record jacket itself without damaging the shrink wrap or the record jacket. The film material may or may not include an adhesive on the film material, but if an adhesive is present, the adhesive must be capable of removal together with the film material, and must not permanently adhere to the shrink wrap or the record jacket 14. In at least one embodiment, the jacket protective means or film material is held in place by itself with no bonding or adhesive. That is, the ends of a length of film material would cling to itself, but not to the shrink wrap or record jacket. In one embodiment, the film material is heat sealed to itself upon application of heat using heat devices known in the art.

With respect to the width of the film material, the stretchable film material of the jacket protective means 24 is at least 1.5 inches in width and, more preferably, at least 2 inches in width. In other embodiments, the stretchable film material may be between about 1.5 inches and about 6 inch in width, in other embodiments between about 1.75 inches and about 5 inches in width, and in yet other embodiments between about 2 inches and about 4 inches in width. In one embodiment of the present invention, the stretchable film material of the jacket protective means 24 is about 2 to about 3 inches in width. No matter how wide the stretchable film material used, it should be applied around the vertical central axis y and the horizontal central axis x so as to be effective in preventing seam splits.

With respect to the thickness of the film, the stretchable film material of the jacket protective means 24 should have a thickness between about 120 gauge and 40 gauge. In some embodiments, the stretchable film material of the jacket protective means 24 has a thickness between about 100 gauge and 60 gauge, and in yet other embodiments the stretchable film material of the jacket protective means 24 has a thickness between about 90 gauge and 70 gauge. In at least one embodiment of the present invention, the stretchable film material of the jacket protective means 24 has a thickness of about 80 gauge. It will be appreciated that thicknesses less than 40 gauge could also be used if the stretchable film material of sufficient length as to be capable of being wrapped around the vertical central axis y or the horizontal central axis x more then once. Thus, for example, a stretchable film material having a thickness of 30 gauge could be used if it is of sufficient length to be wrapped around a central axis of the record jacket at least twice and preferably at least three times. While any gauge thickness of the stretchable film material can be used, it will also be appreciated that wrapping the edges of the record jacket at the central axes x and y more than once or twice with 100 gauge or thicker film material is unnecessary and simply a waste of film material, as the ability of the film material to absorb the energy from the movement of the record within the record jacket is not that great and can be overcome and absorbed by film material with one application of wrapping.

The film material may be clear or transparent in color or opaque. In at least one embodiment, the film material will have a full color appearance with a contrasting color for indicia or text thereon. It will be appreciated that the addition of color and indicia to such film materials in already well known in the art and not detailed herein. In one embodiment of the present invention, the stretchable film material of jacket protective means 24 will be clear and will include small text and an infinity marking system that can indicate the date of production of the record. It is also contemplated that the stretchable film material of jacket protective means 24 can have other security codes embedded therein.

In operation, it will be understood the jacket protective means 24 may be applied by hand or by machine around either the horizontal central axis x first or the vertical central axis y first. In one or more embodiments of the present invention, the horizontal application 24*b* of the jacket protective means can be applied by hand or with automated equipment. In one or more embodiments of the present invention, the vertical application 24*a* of the jacket protective means can be applied either by hand or with automated equipment.

However, in one preferred embodiment, it is believed that the horizontal application 24*b* of the jacket protective means should be applied first to the shrink-wrapped record jacket 22 around the horizontal central axis x. Once the horizontal application 24*a* of the jacket protective means has been applied, then the vertical application 24*b* of the jacket protective means can be applied such that a portion of the vertical application 24*b* is applied directly over a portion of the horizontal application 24*a* around vertical central axis y. This is because the opening edge of the record jacket is most likely at the right or left side of the record jacket and any slicing or removal of the shrink wrap will still not enable to the record to be removed without first unwrapping the horizontal application 24*b* of the jacket protective means. Thus, by wrapping the horizontal central axis x first, it will be appreciated that one also has to first unwrap the vertical application 24*a* of the jacket protective means first before unwrapping the horizontal application 14*b* of the jacket protective means. This prevent undesired tampering with the record.

In one embodiment, application of the jacket protective means 24*a* prior to application of the jacket protective means 24*b* also allows for the jacket protective means 24 to supply a tamper-resistant seal (not shown) under the film material of the horizontal application 24*a* of the jacket protective means 24 that prevents undesired persons from opening the shrink-wrapped record jacket 22 protected with the jacket protective means 24 of the present invention so as to remove the record, without it being known. When the protective means 24 is applied as discussed above, it provides a thin tamper resistant seal that prevents individuals from slicing open the jackets and switching out the record 10 and/or adding or removing other contents to or from the outer record jacket.

In one or more embodiments of the present invention, the horizontal application 24*a* of the jacket protective means includes a single layer of the stretchable film material, and in other embodiments of the present invention, the horizontal application 24*a* of the jacket protective means includes a plurality of layers of the stretchable film material. In one embodiment of the present invention, the horizontal application 24*a* of the jacket protective means includes two layers of the stretchable film material.

In one or more embodiments of the present invention, the vertical application 24*b* of the jacket protective means includes a single layer of the stretchable film material, and in other embodiments of the present invention, the vertical application 24*b* of the jacket protective means includes a plurality of layers of the stretchable film material. In one embodiment of the present invention, the vertical application 24*b* of the jacket protective means includes two layers of the stretchable film material.

Figure 3:
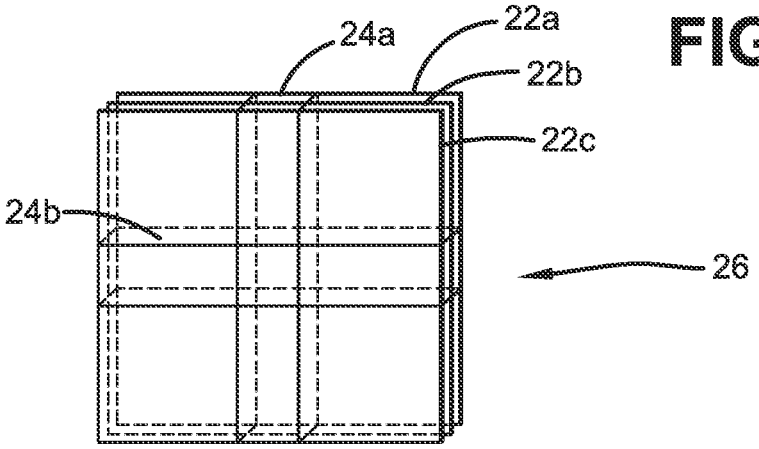
FIG. 3 shows a plurality of jacketed records, each individually covered in shrink wrap, and wherein the plurality of shrink-wrapped records is protected by the jacket protection means of the present invention.

In another embodiment of the present invention, the jacket protective means can be utilized to safely bind multiple records together for shipment to a customer. FIG. 3 shows a plurality of shrink-wrapped record jackets 22*a*, 22*b*, and 22*c* bound together with jacket protective means 24. As shown in FIG. 3, each shrink-wrapped record jackets 22*a*, 22*b*, and 22*c* are stacked on top of each other to create a stack 26 of shrink-wrapped record jackets 22. The jacket protective means 24 of the present invention is then applied over the stack 26 of shrink-wrapped records. Like FIG. 2, jacket protective means 24 comprises one or more layers of a stretchable film material wrapped around the horizontal axis x and the vertical axis y of each of stack 26 of shrink-wrapped record jackets 22. FIG. 3 shows a horizontal application 24*a* of the jacket protective means and a vertical application 24*b* of the jacket protective means.

It is also contemplated that certain embodiments of the protective means 24 will only be provided to record companies that produce new records. By using the protective means 24 of the present invention, it will be evident to customers which records are genuine and which ones are counterfeit because the counterfeit records will not be sealed with the protective means 24 of the present invention that would only be sold to the record producers.

In light of the foregoing, it should be appreciated that the present invention significantly advances the art by providing a jacket protective means that is structurally and functionally improved in several ways. While embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A method for protecting an at least one outer record jacket wrapped in a shrink wrap and containing at least one record against a seam split comprising:

applying at least one layer of stretchable film material, other than the shrink wrap, capable of preventing a seam split around only a horizontal central axis and a vertical central axis of the outer record jacket containing at least one record.

2. The method of claim 1, further comprising a step of placing each of the least one record in an inner protective envelope to provide at least one enveloped record.

3. The method of claim 2, further comprising a step of placing each of the at least one enveloped record into an outer record jacket of the at least one outer record jacket to provide at least one jacketed record.

4. The method of claim 3, further comprising a step of covering the at least one jacketed record with a layer of protective shrink wrap to provide at least one shrink-wrapped record jacket, wherein the shrinkable film material does not cling to the shrink wrap.

5. The method of claim 4, wherein the at least one layer of stretchable film material capable of preventing a seam split is applied directly over the protective shrink wrap along only the horizontal central axis and vertical central axis of the outer record jacket.

6. The method of claim 5, wherein there are a plurality of records, wherein each record of the plurality of records is individually placed within separate inner protective envelopes to create a plurality of enveloped records, wherein each enveloped record of the plurality of enveloped records is individually placed within separate outer record jackets of the at least one outer record jacket to create a plurality of jacketed records, wherein each jacketed record of the plurality of jacket records is individually covered with a layer of protective shrink wrap to create a plurality of shrink-wrapped record jackets, wherein each shrink-wrapped record jackets of the plurality of shrink-wrapped record jackets are stacked on top of one another to create a stack of shrink-wrapped record jackets, and wherein the at least one layer of stretchable film material is applied around only the horizontal central axis of the stack of shrink-wrapped record jackets followed by the at least one layer of stretchable film material being applied around only the vertical central axis of the stack of shrink-wrapped record jackets.

7. The method of claim 1, wherein the step of applying includes first applying at least one layer of stretchable film material around only the horizontal central axis of the outer record jacket of the at least one record followed by applying the at least one layer of stretchable film material around only the vertical central axis of the outer record jacket of at least one record.

8. The method of claim 7, wherein the step of applying includes applying two layers of stretchable film material around the horizontal central axis of the outer record jacket of the at least one record followed by application of two layers of stretchable film material around the vertical central axis of the outer record jacket of the at least one record.

9. The method of claim 1, wherein each of the at least one layer of stretchable film material is between 1.5 inches and 6 inch in width.

10. The method of claim 1, wherein each of the at least one layer of stretchable film material has a thickness between 120 gauge and 40 gauge.

11. The method of claim 1, wherein the step of applying is done by hand.

12. The method of claim 1, wherein the step of applying is done with the use of automated equipment.

* * * * *